US006907827B2

(12) United States Patent
Tirmizi

(10) Patent No.: US 6,907,827 B2
(45) Date of Patent: Jun. 21, 2005

(54) PYROTECHNIC INITIATOR HAVING OUTPUT CAN WITH ENCAPSULATION MATERIAL RETENTION FEATURE

(75) Inventor: Abrar A. Tirmizi, Simi Valley, CA (US)

(73) Assignee: Special Devices, Inc., Moorpark, CA (US)

( * ) Notice: Subject to any disclaimer, the term of this patent is extended or adjusted under 35 U.S.C. 154(b) by 0 days.

(21) Appl. No.: 10/295,202

(22) Filed: Nov. 14, 2002

(65) Prior Publication Data

US 2004/0094059 A1 May 20, 2004

(51) Int. Cl.[7] ..... F42B 3/10; F42C 11/00

(52) U.S. Cl. ..... 102/202.12; 102/202.5

(58) Field of Search ..... 102/200, 202.12, 102/202.2, 202.5, 202.4, 202.9, 202.14; 206/701

(56) References Cited

U.S. PATENT DOCUMENTS

| | | | | | |
|---|---|---|---|---|---|
| 4,223,005 | A | * | 9/1980 | Teodorescu et al. | 435/7.24 |
| 4,617,607 | A | | 10/1986 | Park et al. | 361/283 |
| 5,140,906 | A | * | 8/1992 | Little, II | 102/202.14 |
| 5,204,491 | A | * | 4/1993 | Aureal et al. | 102/202.14 |
| 5,315,877 | A | | 5/1994 | Park et al. | 73/724 |
| 5,329,819 | A | | 7/1994 | Park et al. | 73/724 |
| 5,556,132 | A | * | 9/1996 | Sampson | 280/741 |
| 5,634,660 | A | * | 6/1997 | Fink et al. | 280/741 |
| 5,686,691 | A | * | 11/1997 | Hamilton et al. | 102/202.5 |
| 5,695,215 | A | * | 12/1997 | Headley et al. | 280/737 |
| 5,847,310 | A | * | 12/1998 | Nagahashi et al. | 102/202.6 |
| 5,889,228 | A | * | 3/1999 | Ewick et al. | 102/275.5 |
| 5,932,832 | A | * | 8/1999 | Hansen et al. | 102/202.4 |
| 6,009,809 | A | * | 1/2000 | Whang | 102/202.7 |
| 6,073,963 | A | * | 6/2000 | Hamilton et al. | 280/741 |
| 6,164,208 | A | * | 12/2000 | Hsu et al. | 102/202.5 |
| 6,220,163 | B1 | * | 4/2001 | Duguet et al. | 102/202.2 |
| 6,311,621 | B1 | * | 11/2001 | Marshall et al. | 102/202.5 |
| 6,341,562 | B1 | * | 1/2002 | Brisighella | 102/202.14 |
| 6,408,759 | B1 | * | 6/2002 | Ewick et al. | 102/202.5 |
| 6,446,557 | B1 | * | 9/2002 | Lubbers | 102/202.9 |
| 6,553,914 | B2 | * | 4/2003 | Hosey et al. | 102/530 |
| 6,578,487 | B2 | * | 6/2003 | Avetisian et al. | 102/202.7 |

OTHER PUBLICATIONS

Ernest F. Nippes, "Resistance welding", in AccessScience@McGraw–Hill, http://www.accessscience.com, DOI 10.1036/1097–8542.582500, last modified: May 24, 2001.*

Insert molding article by Jim Vance, Jr.□□© Canon Communications LLC 2002, Originally published Apr. 1996 □□Available @ http://www.devicelink.com/mddi/archive/96/04/010.html□□.*

Reaction Injection Molding article by Fred T. Wickis, Jr.□□© Canon Communications LLC 2002, Originally published Apr. 1996 □□Available @ http://www.devicelink.com/mddi/archive/96/04/014.html□□.*

* cited by examiner

*Primary Examiner*—Michael J. Carone
*Assistant Examiner*—Daniel Lawson Greene, Jr.
(74) *Attorney, Agent, or Firm*—Law Offices of Thomas J. Brindisi

(57) ABSTRACT

A pyrotechnic initiator is provided with an encapsulation material retention feature on the output can, such as a swaged end or anchors.

13 Claims, 3 Drawing Sheets

PYROTECHNIC INITIATOR HAVING OUTPUT CAN WITH ENCAPSULATION MATERIAL RETENTION FEATURE

BACKGROUND OF THE INVENTION

The present invention generally relates to the field of pyrotechnic initiators, and more particularly to a pyrotechnic initiator with an output can that has an encapsulation material retention feature.

Pyrotechnic initiators have many uses in industrial and consumer applications. One important use is in triggering the inflation of airbags in motor vehicles. Significant efforts have been made in the automotive industry to reduce the cost of manufacturing reliable airbag initiators, but there remains a need for further reduction in the costs of manufacturing reliable initiators.

In particular, initiators have been made with an encapsulation of insulator material such as nylon. In existing encapsulated initiator designs, secure adherence of the encapsulation material to the body of the initiator may be enhanced through a retention feature on the header assembly called a backdraft. There are several disadvantages with the backdraft, however. First, the backdraft is applied through an expensive machining operation. Second, if the initiator contains onboard circuitry, the backdraft requires that the output can be held flush with the header to a tight tolerance after welding so as to prevent shorting of the circuitry. Third, the amount of encapsulation material captured by the backdraft is limited by the space available on the header assembly. Fourth, with a backdraft, weakness in the weld can make the output can prone to ejecting upon firing of the initiator.

Thus, there remains a need for improving the manner of retention of encapsulation material to the initiator body in encapsulated initiators. In this regard, it is believed that an encapsulation material retention feature has never been provided on the output can of an initiator.

SUMMARY OF THE INVENTION

In accordance with the present invention, a pyrotechnic initiator is provided with an encapsulation material retention feature on the output can rather than the header assembly, thus removing an expensive machining operation and replacing it with an inexpensive standard stamping or deep drawing operation. Specifically, the bottom of the output can may be swaged over the bottom of the header assembly and/or stamped with anchors, providing an effective and economical encapsulation material retention feature.

DETAILED DESCRIPTION OF PREFERRED EMBODIMENTS

Figure 1:
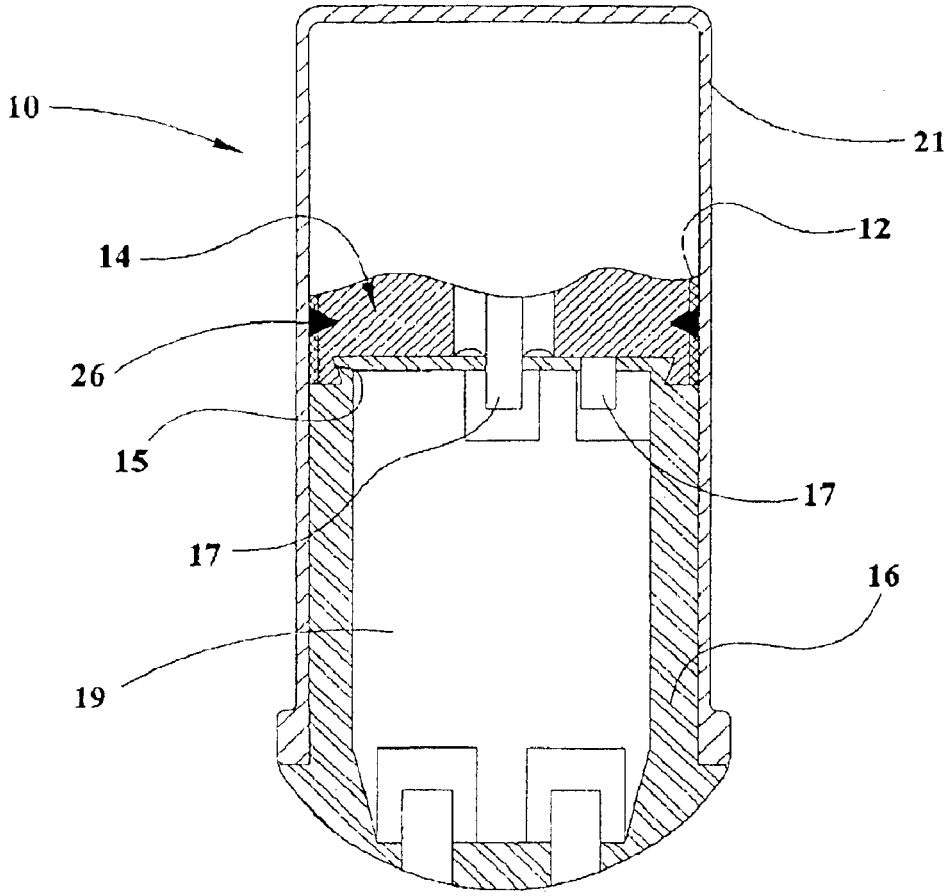
Figure 1 (Prior Art)
FIG. 1 is a side sectional view of a prior art encapsulated initiator having an output can with a backdraft.
Figure 2:
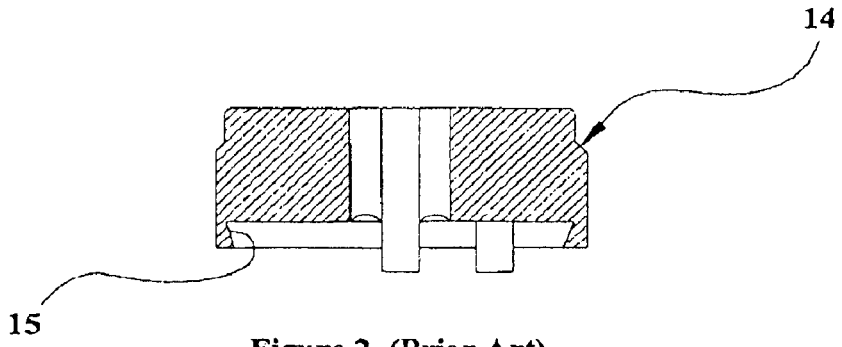
Figure 2 (Prior Art)
FIG. 2 is a side sectional view of the header assembly portion of the initiator of FIG. 1.

Referring to FIGS. 1 and 2, a prior art encapsulated initiator 10 is shown. As can be seen, the initiator 10 includes an insulator cup 21, and the bottom of the output can 12 is cylindrical and ends flush with the bottom of the header 14. The bottom of the header 14 includes a backdraft 15 that serves to retain the encapsulation material 16. Electrical connectors 17 are provided within the initiator 10, and may be adapted to connect to an internal circuit board 19. (It is noted that identical features in subsequent Figures are referenced with the same reference numbers).

Figure 3:
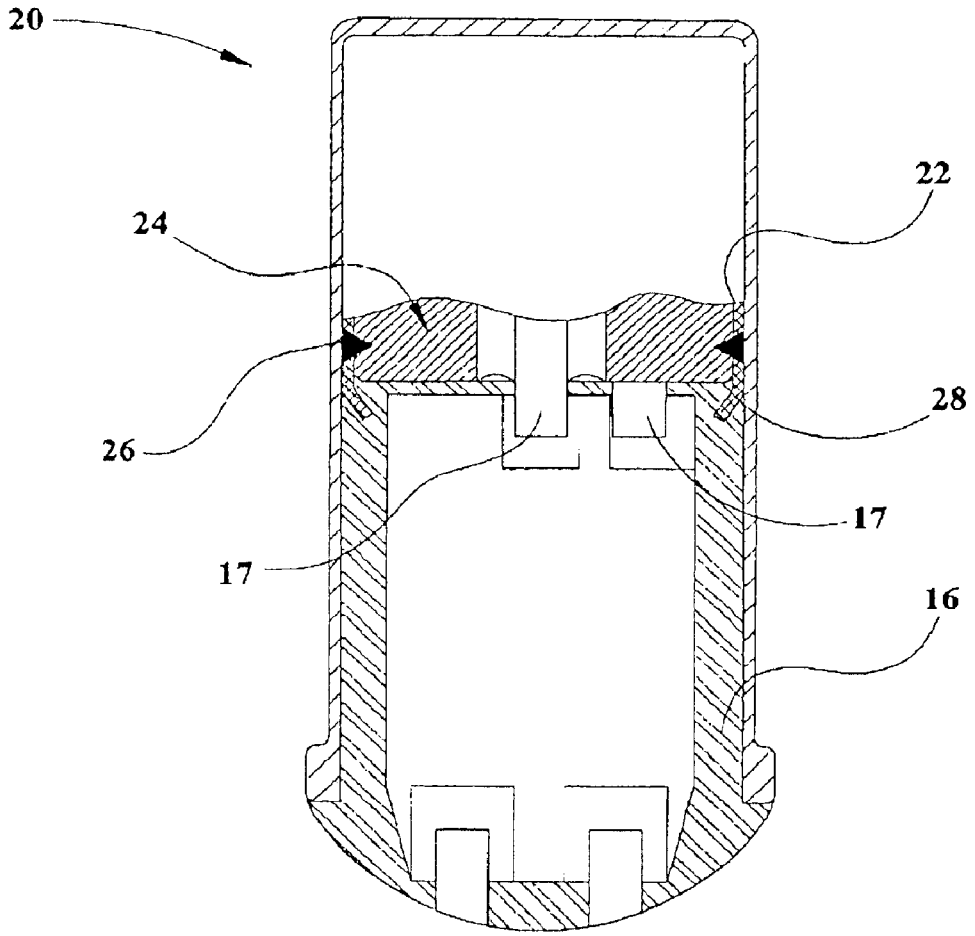
FIG. 3 is a side sectional view of an encapsulated initiator having an encapsulation material retention feature on the output can according to the present invention.
Figure 4:
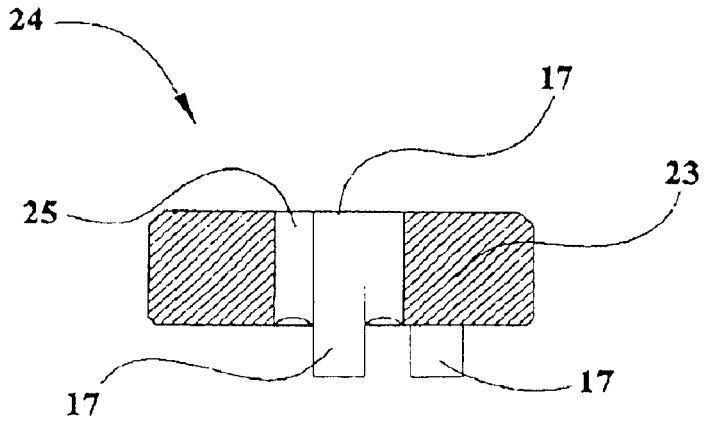
FIG. 4 is side sectional view of the header assembly portion of the initiator of FIG. 3.

In a preferred embodiment of the present invention, shown in FIGS. 3 and 4, an initiator 20 includes a header 24 (including an eyelet 23, glass insulator 25, and at least one electrode 17 within the glass insulator 25) with no backdraft, and an output can 22 having a bottom that extends beyond and is swaged over the bottom of the header 24. The swaged-over portion 28 of the bottom of the output can 22 thus serves to retain the encapsulation material 16, and it provides added structural support to help prevent the header assembly from moving up or down and to help prevent the output can from ejecting if the weld fails during firing.

As can be seen from a comparison of FIGS. 1 and 3, the output can 22 is preferably slightly longer (e.g., 0.75 mm longer before swaging) than a similar output can 12 used with a backdrafted header 14. Also, as can be seen from a comparison of FIGS. 2 and 4, the outer bottom circumferential edge of header 24 is preferably slightly beveled rather than straight.

The embodiment of FIGS. 3 and 4 may be constructed by loading and consolidating a suitable pyrotechnic charge in the output can 22 as is known in the art, with the excess length of the output can 22 protruding somewhat beyond the bottom of the header 24. The header and output can may then be suitably bonded together by a commonly used circumferential through-wall weld process (e.g., laser, stitch, or resistance welding), such as is shown at circumferential laser weld points 26. After attaching the output can 22 to the header 24, the retention feature (i.e., swaged-over portion 28) is then added to the bottom of the output can 22 by swaging over its edges inwardly at a suitable angle (e.g., 37° to 45°). The output can is preferably swaged so as to retain more encapsulation material than a typical backdraft design. Swaging can be accomplished easily with a single step swaging tool after welding, or after attaching a circuit board assembly to the ignition element. Since this eliminates the backdraft machining step, a stamped eyelet may therefore be acceptable for use in the header assembly.

Figure 5:
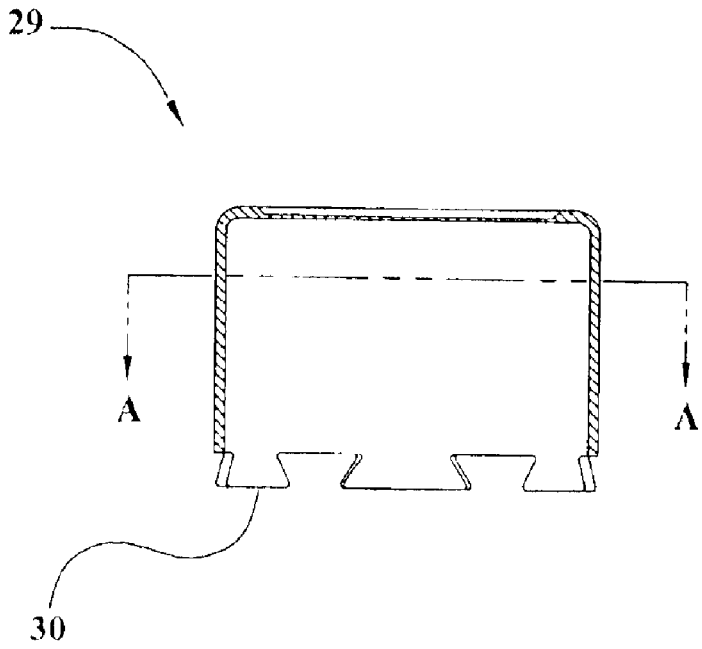
FIG. 5 is a side sectional view of an output can having an encapsulation material retention feature according to an alternate embodiment of the present invention.
Figure 6:
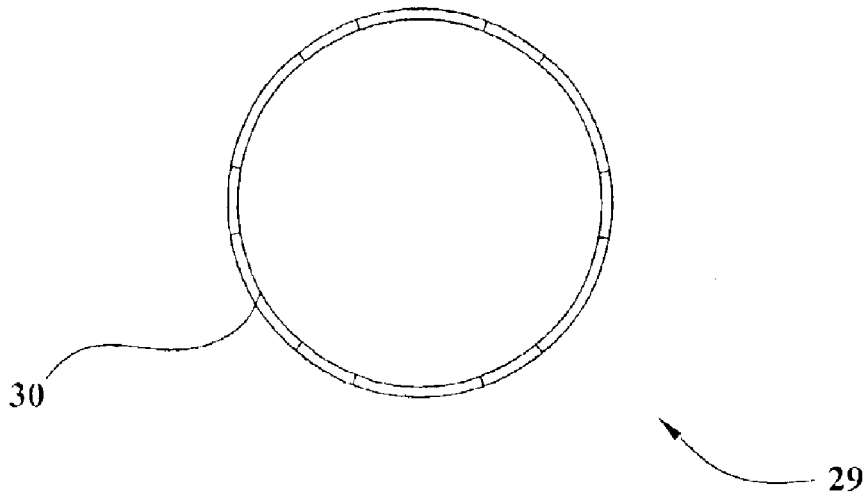
FIG. 6 is a top sectional view of the output can of FIG. 5, taken through line A—A.

As shown in FIGS. 5 and 6, an alternate output can 29 according to the present invention may alternately (or in addition to another retention feature such as the swaging of the embodiment of FIGS. 3 and 4) have one or more anchors 30 stamped on its ends as a retention feature. In any embodiment of the present invention, the retention feature on the output can is preferably made without increasing the overall diameter of the initiator assembly. This is particularly so if the size of the initiator package needs to be maintained within dimensions that are already substantially occupied by other aspects of the initiator such as onboard circuitry.

Two batches of six inert swaged can initiators according to the embodiment of the invention shown in FIGS. 3 and 4 were made and tested on a Chittallon machine. The first batch employed glass-filled Zytel® as the encapsulation material, and tested to an average retention force in excess of 80 lb. ft. The second batch employed glass-filled Reaction Injection Molded ("RIM") material as the encapsulation material, and tested to an average resulting retention force of 90 lb. ft. This meets or exceeds the retention force offered by a backdraft header.

Preferred embodiments of a pyrotechnic initiator with an output can having an encapsulation material retention feature, and many of the attendant advantages, have thus been disclosed. It will be apparent, however, that various changes may be made in the form, construction, and arrangement of the parts without departing from the spirit and scope of the invention, the form hereinbefore described being merely preferred or exemplary embodiments thereof. Therefore, the invention is not to be restricted or limited except in accordance with the following claims.

What is claimed is:

1. A method of making a pyrotechnic initiator, comprising the steps of:

a) providing a header assembly having a top end and a bottom end, said bottom end including one or more electrical connectors;

b) providing an output can with an encapsulation material retention feature that extends inwardly on its bottom end;

c) attaching said output can to said header assembly;

d) encapsulating at least part of said bottom end of said header assembly and said encapsulation material retention feature with an encapsulation material in intimate encapsulated contact with said at least part of said bottom end of said header assembly and said encapsulation material retention feature; and, e) attaching a circuit board to said electrical connectors, wherein said circuit board is laterally surrounded by said encapsulation material;

wherein said encapsulation material adjacent said encapsulation material retention feature does not substantially exceed the profile of said output can.

2. The method of claim 1, wherein step b) is not completed until after step c).

3. The method of claim 2, wherein step b) comprises swaging the bottom end of said output can.

4. The method of claim 1, wherein step c) includes circumferentially laser welding said output can to said header assembly.

5. The method of claim 1, wherein said header assembly includes a stamped eyelet.

6. The method of claim 1, wherein said encapsulation material retention feature includes a swaged end.

7. The method of claim 1, wherein said encapsulation material retention feature includes one or more stamped anchors.

8. The method of claim 1, wherein said output can is attached to said header assembly with a through wall welding process.

9. The method of claim 1, wherein said bottom end of said header assembly further includes a feature corresponding to said encapsulation material retention feature of said output can.

10. The method of claim 9, wherein said encapsulation material retention feature includes a swaged end at said bottom end of said output can, and said corresponding feature of said header assembly comprises a circumferential bevel.

11. The method of claim 1, wherein said encapsulation material retention feature at said bottom end of said output can does not extend outwardly beyond the profile of the rest of said output can.

12. The method of claim 3, wherein said encapsulation material retention feature at said bottom end of said output can does not extend outwardly beyond the profile of the rest of said output can.

13. The method of claim 12, wherein said swaging is performed with a one-step swaging tool.

* * * * *